US011511203B2

(12) United States Patent
Norquist et al.

(10) Patent No.: US 11,511,203 B2
(45) Date of Patent: Nov. 29, 2022

(54) SWING DESIGNED TO PROMOTE ATTUNEMENT BETWEEN CHILD AND CARETAKER

(71) Applicant: PlayCore Wisconsin, Inc., Chattanooga, TN (US)

(72) Inventors: Thomas Robert Norquist, Fort Payne, AL (US); Kim Corvin Blackwood, Boaz, AL (US); Charles Lebron Griffith, IV, Fort Payne, AL (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 0 days.

(21) Appl. No.: 17/125,294

(22) Filed: Dec. 17, 2020

(65) Prior Publication Data

US 2021/0101084 A1 Apr. 8, 2021

Related U.S. Application Data

(63) Continuation of application No. 16/509,783, filed on Jul. 12, 2019, now Pat. No. 10,888,793, which is a continuation of application No. 15/921,367, filed on Mar. 14, 2018, now Pat. No. 10,391,411, which is a continuation of application No. 15/148,429, filed on May 6, 2016, now Pat. No. 9,950,265, which is a continuation of application No. 14/740,495, filed on Jun. 16, 2015, now abandoned, which is a continuation of application No. 13/974,762, filed on Aug. 23, 2013, now Pat. No. 9,084,940.

(51) Int. Cl.
*A63G 9/00* (2006.01)
*A47D 13/00* (2006.01)

(52) U.S. Cl.
CPC ..... *A63G 9/00* (2013.01); *A47D 13/00* (2013.01)

(58) Field of Classification Search
CPC ..... A63G 9/00; A63G 9/12; A63G 9/02; A47D 13/105; A47D 9/02
USPC ..... 472/118–125
See application file for complete search history.

(56) References Cited

U.S. PATENT DOCUMENTS 282,934 A 8/1883 Tully
317,028 A * 5/1885 Shields
(Continued)

FOREIGN PATENT DOCUMENTS

EP 2067510 A1 6/2009

OTHER PUBLICATIONS

Lee Ji-Sun swing picture from Pinterest, printed on May 8, 2013.

*Primary Examiner* — Kien T Nguyen
(74) *Attorney, Agent, or Firm* — McAndrews, Held & Malloy, Ltd.

(57) ABSTRACT

The present invention provides a swing that is operable to promote attunement between a child and caretaker. The swing comprises two seats, one of the two seats being configured to be occupied by a caretaker, such as a parent, and another of the two seats being configured to be occupied by a child. The two seats are arranged so that the caretaker and the child can face one another and comfortably see each other's eyes. The two seats are also configured such that, during operation of the swing, both the caretaker and child share the experience of swinging. Thus, using the swing of at least one embodiment of the present invention, a caretaker and child may share the mutual enjoyment of the swinging action while maintaining eye contact with one another, resulting in attunement.

17 Claims, 3 Drawing Sheets

(56) References Cited

U.S. PATENT DOCUMENTS

| | | | | |
|---|---|---|---|---|
| 383,533 | A | 5/1888 | Bettes | |
| 868,640 | A | 10/1907 | Buch | |
| D76,611 | S * | 10/1928 | Ferris | |
| 1,886,904 | A | 11/1932 | Rice | |
| 2,358,098 | A | 9/1944 | Pippin | |
| 2,524,967 | A | 10/1950 | Ellis | |
| 3,663,016 | A | 5/1972 | Morris | |
| 3,918,709 | A | 11/1975 | Bishop | |
| 4,256,300 | A | 3/1981 | Boucher | |
| 4,417,725 | A | 11/1983 | Van Horn | |
| 4,570,928 | A | 2/1986 | Smith | |
| 4,699,423 | A | 10/1987 | Fitzig et al. | |
| 5,031,605 | A | 7/1991 | Mills | |
| D341,948 | S | 12/1993 | Nolan | |
| 5,344,212 | A | 9/1994 | Muller et al. | |
| 5,875,779 | A | 3/1999 | Fuhrman et al. | |
| 6,482,096 | B1 | 11/2002 | Rieber et al. | |
| 6,994,631 | B1 * | 2/2006 | Habing | A47C 3/0255 472/125 |
| 7,300,355 | B1 | 11/2007 | Hense | |
| D591,004 | S | 4/2009 | Rickman | |
| 7,578,746 | B1 | 8/2009 | Johnson | |
| 8,282,498 | B2 | 10/2012 | Publicover | |
| 2005/0107173 | A1 * | 5/2005 | Pelletier | A63G 9/12 472/118 |
| 2009/0131184 | A1 | 5/2009 | Pizmony | |

* cited by examiner

SWING DESIGNED TO PROMOTE ATTUNEMENT BETWEEN CHILD AND CARETAKER

This application is a continuation of U.S. patent application Ser. No. 16/509,783, filed Jul. 12, 2019, which is a continuation of U.S. patent application Ser. No. 15/921,367, filed on Mar. 14, 2018, which is a continuation of U.S. patent application Ser. No. 15/148,429, filed on May 6, 2016 and granted as U.S. Pat. No. 9,950,265 B2, which is a continuation of U.S. patent application Ser. No. 14/740,495, filed on Jun. 16, 2015, which is a continuation of U.S. patent application Ser. No. 13/974,762, filed on Aug. 23, 2013 and granted as U.S. Pat. No. 9,084,940 B2, the content of each of which is hereby incorporated by reference in its entirety.

BACKGROUND OF THE INVENTION

When a child reaches the young age of a few months, the child and caretaker begin to develop a harmonic meeting of the minds. This is largely achieved through a coordination of behavior that begins with eye contact. For example, the child may look into its mother's eyes and smile or laugh. This, in turn, will cause the mother to smile or laugh in response. This coordination of behavior has been described using terms such as interactive synchrony, matching, coherence, co-occurrence, attunement, and, more generally, bonding. For simplicity, this face-to-face coordination of behavior between child and caretaker will herein generally be referred to as attunement.

Attunement occurs when a caretaker and infant synchronize their gaze patterns and the affective tone of their interaction. As the caretaker is sensitive and responsive to changes in the child's emotions, the child responds to the caretaker's sensitive behaviors. As caretaker and child become attuned to each other, their interactions become more synchronized and harmonious.

It has been found that attunement is important both for establishing a successful relationship between the child and caretaker and for promoting the infant's emotional development. The importance of this face-to-face coordination of behavior between child and caretaker continues throughout infancy and into toddlerhood.

Attunement between a child and caretaker is critical for the establishment of a mutual understanding between the child and the caregiver. Attunement has been shown to produce a decrease in negative behavior, such as crying and infant gaze aversion, as well as in increase in positive behaviors, such as attentiveness and affective displays, e.g. smiling and laughing. In general, attunement results in a child having an increased enjoyment of the caretaker-child interactions. As such, attunement is an important factor in developing a relationship that is close, mutually binding, cooperative, and affectively positive. Children growing up with caretakers who are responsive to their needs and whose interactions are infused with happy emotions adopt a willing, responsive stance toward caretaker influence.

Attunement also plays an important role in promoting the emotional development of the child. A child's learning of social skills and conventional forms of communication and culture begins with attunement. A child who does not experience attunement has difficulty forming healthy attachments and is more likely to become emotionally brittle. It has also been theorized that attunement buffers the child against excessive surges of emotion and helps orchestrate genetic signals that govern optimal brain development during childhood as well as further into adolescence and young adulthood.

SUMMARY OF THE INVENTION

It is an object of at least one embodiment of the present invention to provide a swing that is operable to promote attunement between a child and caretaker. The swing comprises two seats, one of the two seats being configured to be occupied by a caretaker and another of the two seats being configured to be occupied by a child. The term caretaker, as used herein, can refer to anyone who has interaction with a child and includes, without limitation, a parent, guardian, grandparent, nanny, or older sibling. The two seats are arranged so that the caretaker and the child can face one another and comfortably see each other's eyes. The two seats are also configured such that, during operation of the swing, both the caretaker and child share the experience of swinging. Thus, using the swing of at least one embodiment of the present invention, a caretaker and child may share the mutual enjoyment of the swinging action while maintaining eye contact with one another, resulting in attunement.

It is another object of at least one embodiment of the present invention to provide a swing that comprises a first seat, a second seat, and a connector that is configured to join the first seat and the second seat such that the first and second seats undergo a shared swinging action during operation of the swing. The first seat is configured to be occupied by an adult and the second seat is configured to be occupied by a child. The second seat is a child swing seat that is specifically designed for safe use by a child.

It is another object of at least one embodiment of the present invention to provide a swing that comprises a first seat, a second seat, and a connector that is configured to join the first seat and the second seat such that the first and second seats undergo a shared swinging action during operation of the swing. The first seat is configured to be occupied by an adult and the second seat is configured to be occupied by a child. The second seat is configured so that the child cannot touch the ground, providing that the adult alone may use the ground to start, stop, and/or regulate the swinging motion.

It is another object of at least one embodiment of the present invention to provide a swing that comprises a first seat, a second seat, and a connector that is configured to join the first seat and the second seat such that the first and second seats undergo a shared swinging action during operation of the swing. The first seat is configured to be occupied by an adult and the second seat is configured to be occupied by a child. The second seat is vertically disposed between about 6 inches and about 16 inches above the first seat, and preferably between about 9 inches and about 13 inches above the first seat.

It is contemplated that the swing of embodiments of the present invention may be used in public playgrounds or sold for residential use at the home. Thus, the swing of embodiments of the present invention may be adapted or modified, as necessary, for public or residential use.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
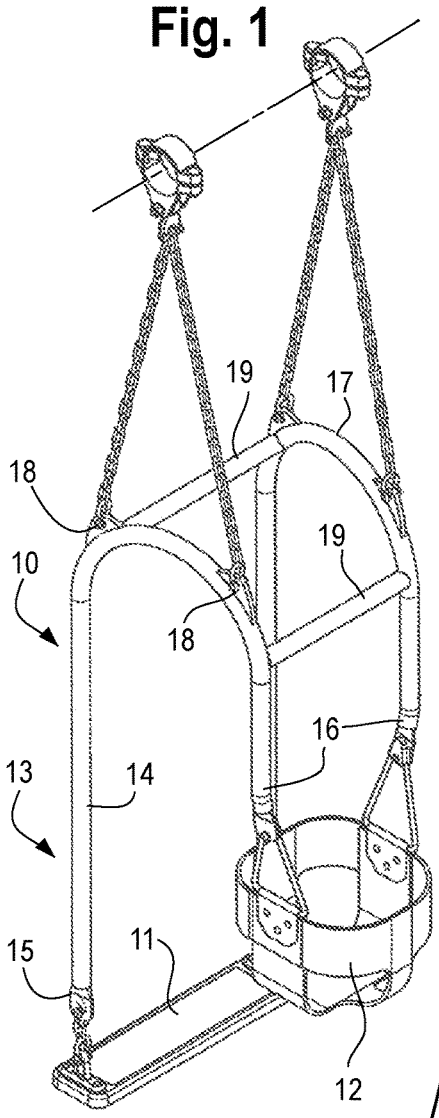
FIG. 1 is a perspective view of an embodiment of the swing.

FIG. 1 shows a swing 10 of a preferred embodiment of the present invention. The swing comprises a first seat 11 and a second seat 12.

The first seat 11 is configured to be occupied by an adult. Accordingly, the first seat may comprise a rigid seat, such a common board seat, or a flexible seat, such as a common belt seat. The first seat 11 may also comprise a backing structure that would support the occupant in an upright position. Thus, the first seat 11 may also comprise, for example, a bench seat or a chair seat. In the preferred embodiment illustrated in FIG. 1, the first seat 11 is a board seat. The board seat of the preferred embodiment provides the occupant with a desirable level of comfort and range of movement, while also maintaining the occupant at a generally fixed eye level relative to the second seat 12.

The second seat 12 is configured to be occupied by a child. The second seat 12, for example, is preferably configured to be safely occupied by a child of age twelve or less, alternatively the second seat 12 is preferably configured to be safely occupied by a child of age five or less, alternatively the second seat 12 is preferably configured to be safely occupied by a child between six months and two years of age. In preferred embodiments, the second seat 12 is configured to be safely occupied by an infant or a toddler. Because attunement is most likely to occur when a child is between a few months and four years of age, embodiments of the swing 10 are preferably configured such that the second seat 12 may be safely occupied by a child that is between a few months and four years of age.

The second seat 12 is preferably a child swing seat. The term child swing seat, as used herein, refers to any swing seat that is designed for safe use by a child, for instance by providing some manner of restraint that assists in preventing the child from falling from the seat or by providing some support that assists the child in sitting upright in the seat. Some non-limiting examples of child swing seats include bucket swing seats, chair swing seats, inclusive play swing seats, glider swing seats, and cradle swing seats.

A bucket swing seat is any seat having at least a segment of the seat that is generally shaped like a bucket, with the segment providing a restraint on the forward, backward, or lateral movement of the occupant. A full bucket seat, for example, is a bucket seat that has a peripheral wall extending around the perimeter of the seat. The full bucket seat typically comprises holes for a child's legs and requires the caretaker to lift a child and place him or her into the seat. In the preferred embodiment illustrated in FIG. 1, the second seat 12 is a full bucket seat. Full bucket seats are sold, for example, under the trade names GameTime® Enclosed Tot Seat and Play&Park Structures® Fully Enclosed Tot Seat. A half bucket seat is a bucket seat that has a peripheral wall that extends only around a portion of the perimeter. Typically, the peripheral wall provides a restraint on at least the backward movement of the occupant. A half bucket seat may also include a front guard that, when closed, restrains the forward movement of the occupant.

A chair swing seat is a child swing seat having at least a bottom support and a back support, calling to mind the shape of a chair. In various embodiments, a chair swing seat may also, but does not necessarily, include a front guard, which restrains the forward movement of the child. The front guard may be integrally formed with or permanently affixed to the chair, in which case, the chair and font guard preferably comprise openings through which a child's legs extend. Preferably, the front guard is moveable between an open position, in which the child may easily be placed into or taken out of the seat, and a closed position. In some embodiments, the front guard comprises a solid component, for example a plastic or cushioned component. Solid component front guards, for example, may slide or rotate between an open and closed position. Alternatively, solid component front guards may be detached from the seat for child loading and reattached to the seat to act as a restraint. In other embodiments, the front guard may comprise a belt or harness that is fastened or clasped in place to form a restraint. Models of chair swing seats are sold, for example, under the trade names Play&Park Structures® Made-for-Me Swing Seat, BigToys® Made-for Me Swing Seat, Play&Park Structures® One-for-All Swing Seat, and BigToys® One-for-All Swing Seat.

In some embodiments, the child swing seat may comprise a swing seat that is adapted for use by children with special needs, sometimes referred to as inclusive play or adaptive swing seats. Inclusive play swing seats, for example, are configured for children that require additional support and typically have a high back, wing support, and an adjustable harness that helps a child maintain a neutral body position and minimizes fatigue. Models of inclusive play swing seats are sold, for example, under the trade names GameTime® Adaptive Swing Seat and GameTime® Zero-G Swing Chair.

In some embodiments, the child seat may comprise a glider swing seat. Models of glider swing seats are sold, for example, under the trade name Swing-N-Slide® Wind Rider Glider Swing. In some embodiments, including especially where the swing is configured for residential use, the child seat may comprise a cradle swing seat.

Preferably, including for example when the swing is designed for residential use, the second seat 12 may be removed and replaced with a different type of second seat. In this way, a child swing seat that is most suitable for a child of a particular age may be used as the second seat 12.

The swing 10 of a preferred embodiment of the present invention also comprises a connector 13. The connector 13 is configured to join the first seat 11 and the second seat 12 such that the first and second seats undergo a shared swinging action during operation of the swing. The connector 13 of a preferred embodiment is illustrated in FIG. 1. In a preferred embodiment, the connector comprises a piped framework 14 having at least a first end 15 and a second end 16. In this embodiment, the first seat 11 is attached to the first end 15 of the framework and the second seat 12 is attached to the second end 16 of the framework.

The first end 15 and second end 16 of the framework must be spaced apart from one another in a horizontal direction, D. As illustrated in FIG. 1, this spacing may be provided by an arched framework structure 17. Although the connector 13 of the preferred embodiment shown in FIG. 1 comprises a piped framework 14 having an arched structure 17 that provides the necessary horizontal spacing between the first end 15 and the second end 16 of the framework, the connector 13 of the present invention is not limited by the design illustrated in FIG. 1. Rather, the connector 13 could provide the necessary horizontal spacing between the first end 15 and the second end 16 of the framework by any suitable means, such as for example by a straight framework structure or an angled framework structure.

Preferably, the first end 15 and the second end 16 of the framework are spaced apart from one another by a distance D between about twelve and about thirty inches. More preferably, the horizontal distance D between the first end 15 and the second end 16 of the framework is between about sixteen and about twenty-six inches. More preferably, the horizontal distance D between the first end 15 and the second end 16 of the framework is between about eighteen and about twenty-four inches. More preferably, the horizontal distance D between the first end 15 and the second end 16 of the framework is between about nineteen and about twenty-three inches.

The connector 13 also comprises at least one suspension point 18, by which the swing 10 is suspended from a support structure 20. Preferably the connector 13 comprises at least two suspension points 18. More preferably, the connector 13 comprises at least four suspension points 18. The inclusion of at least four suspension points 18 provides stability to the swing 10 and prevents the swing from becoming unbalanced, which could result in tipping of the swing during operation. As illustrated in FIG. 1, the connector 13 may also comprise one or more stabilizers 19 that are configured to prevent wobbling or lateral tilting of the swing during operation. For example, the stabilizers 19 may take the form of stabilizing bars that comprise part of the framework 14 or are otherwise attached to the connector 13.

In a preferred embodiment, the first seat 11 is suspended a short distance below the first end 15 of the framework 14. In the unlikely event that a bystander were to be hit by the swing 10 during operation, the suspension of the first seat 11 a short distance below the first end 15 of the framework 14 operates to lessen the impact of the blow on the bystander. Thus, the suspension of the first seat 11 a short distance below the first end 15 of the framework 14 provides an added safety benefit.

Figure 2:
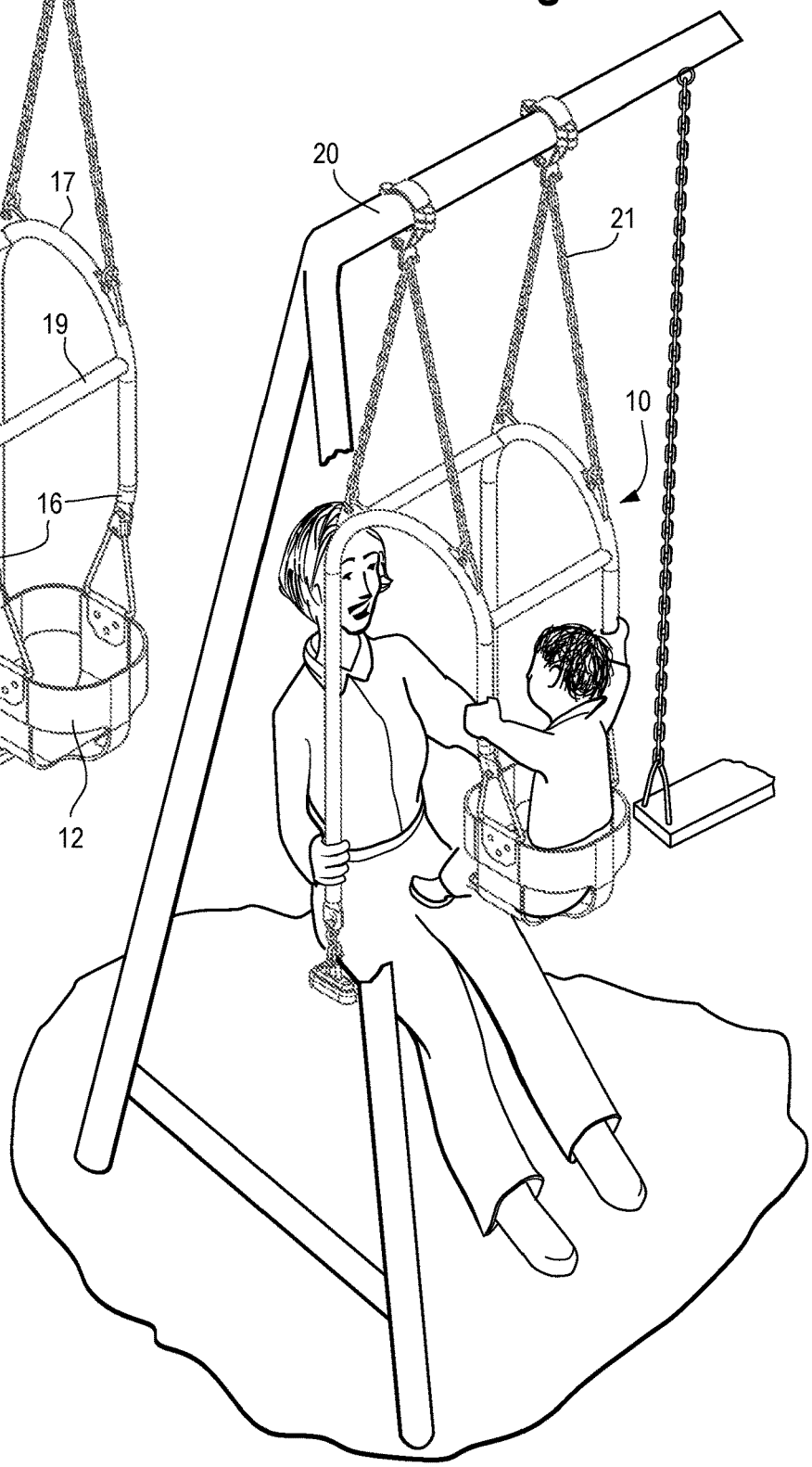
FIG. 2 is a perspective view of an embodiment of the swing, showing use by a caretaker and child in a manner that promotes attunement.

As illustrated in FIG. 2, the swing 10 of embodiments of the present invention is suspended from a swing support structure 20. Because it is contemplated that the swing of embodiments of the present invention may be used in public playgrounds or for use at the home, the swing support structure 20 may be adapted for public or residential use. The swing support structure 20 may be configured to contain or connect to additional playground equipment, or it may be configured to support only the swing 10 of embodiments of the present invention. Suspension of the swing 10 from the support structure 20 may be by any means known in the art. In the embodiment illustrated in FIG. 2, the swing 10 is suspended form the support structure 20 using chains 21, each of which is affixed to a suspension point 18 of the connector 13.

Using the swing 10 of embodiments of the present invention, an adult may occupy the first seat 11 and a child may occupy the second seat 12. The adult may then operate the swing by pushing off of the ground to start and/or increase the swinging motion. Accordingly, the adult may regulate the speed and height of the swinging motion while both the adult and the child experience the enjoyment of the shared swinging motion. In at least one preferred embodiment, the second seat 12 is configured so that the child is unable to touch the ground, providing that the adult alone may push off of the ground to start, stop, and/or regulate the swinging motion.

In at least one embodiment of the present invention, the swing 10 is operable to promote attunement between a child and caretaker. Accordingly, the swing comprises a first seat 11 configured to be occupied by a caretaker, such as a parent, and a second seat 12 configured to be occupied by a child, such as an infant or toddler. The two seats are arranged so that the caretaker and the child can face one another and see each other's eyes. Because the swing is configured so that the caretaker and child make eye contact while experiencing the enjoyment of the shared swinging motion, the swing promotes attunement between the caretaker and child.

Accordingly, in a preferred embodiment of the present invention, the first seat 11 and second seat 12 are arranged such that the caretaker and child face one another and share a common eye level. The phrase common eye level, as used herein, does not require that the caretaker's eyes and the child's eyes be at exactly the same height or distance from the ground. Rather, common eye level, as used herein, encompasses any arrangement in which the line of sight of the adult occupant of the first seat 11 and the line of sight of the child occupant of the second seat 12 are generally aligned such that each may naturally and comfortably maintain eye contact with the other during operation of the swing. When the first seat 11 and the second seat 12 are arranged such that the caretaker and child share a common eye level, the caretaker and the child see each other's enjoyment of the mutual swinging action and are able to coordinate their behavior and interaction with one another. In this manner, operation of the swing 10 promotes attunement between the caretaker and child.

Figure 3:
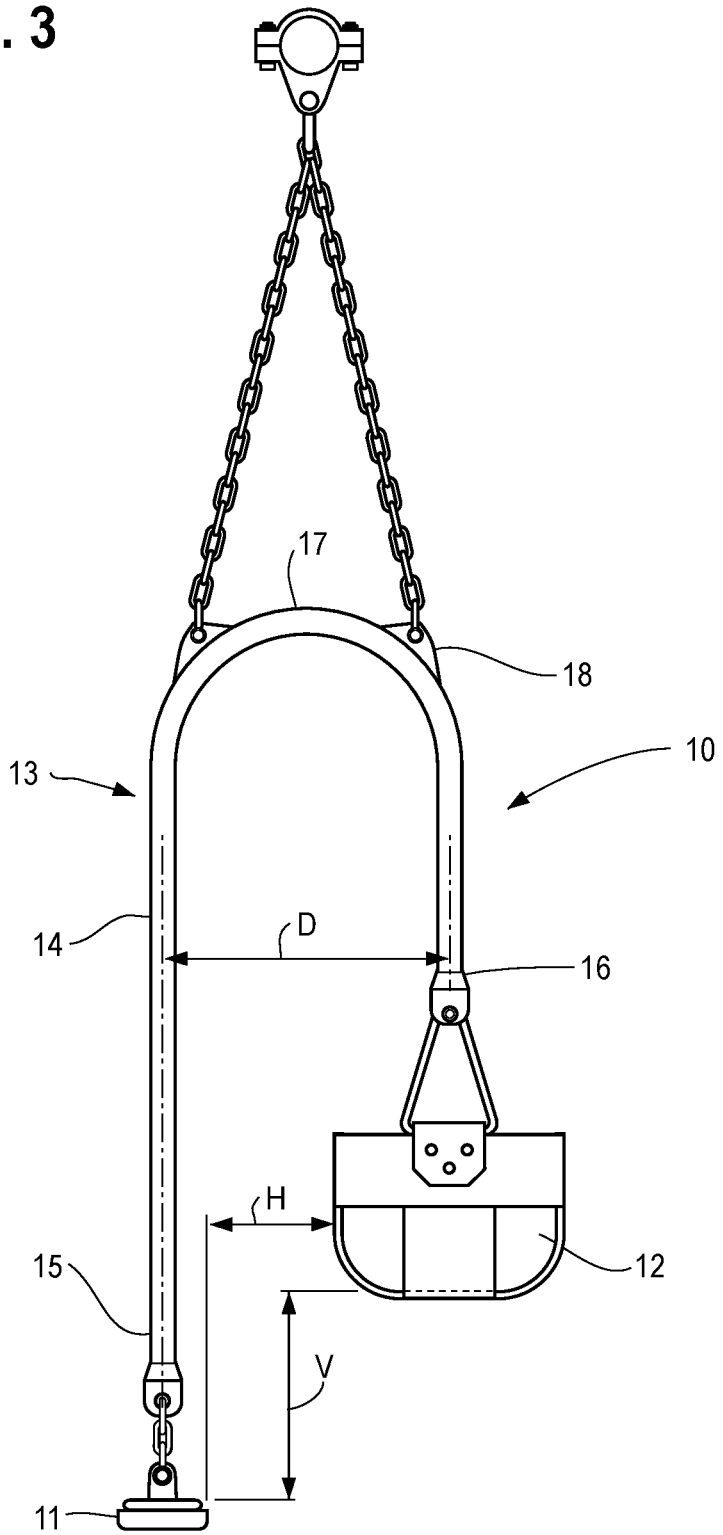
FIG. 3 is a side elevation view of an embodiment of the swing.
Figure 4:
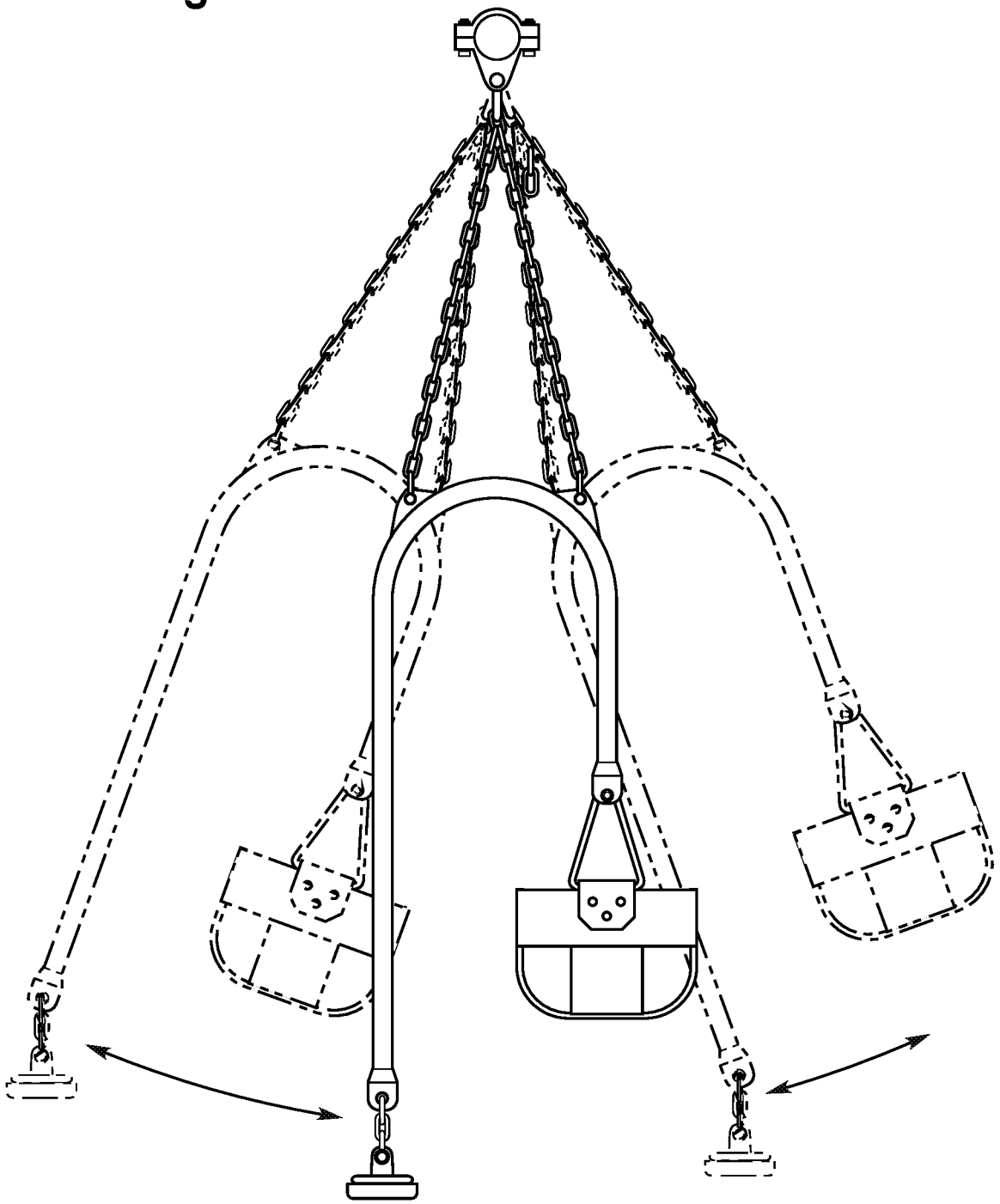
FIG. 4 is a side elevation view of an embodiment of the swing, showing an exemplary motion of the swing during operation.

Taking into account the height differential of the caretaker and the child, the first seat 11 and the second seat 12 are vertically displaced from one another in order to obtain the common eye level. The first seat 11 is thus vertically disposed a distance V below the second seat 12, as illustrated in FIG. 3. Preferably, the vertical distance V between the first seat 11 and the second seat 12 is between about six inches and sixteen inches. More preferably, the vertical distance V between the first seat 11 and the second seat 12 is between about eight and about fourteen inches. More preferably, the vertical distance V between the first seat 11 and the second seat 12 is between about nine and about thirteen inches. More preferably, the vertical distance V between the first seat 11 and the second seat 12 is between about ten and about twelve inches. Given the average height of a caretaker and child, the ranges of vertical displacement will provide a common eye level for most caretakers and children.

In a preferred embodiment, at least one of the first seat 11 and the second seat 12 is vertically adjustable, such as to obtain a common eye level for a caretaker and child having particular heights.

Preferably, the first seat 11 and the second seat 12 are also disposed from one another horizontally by a distance H. The horizontal spacing H of the first seat 11 and the second seat 12 is selected to provide that the occupants of each seat share the mutual enjoyment of the swinging action and that there is no unintended contact between the occupants due to movement of either one of the seats. The first seat 11 and the second seat 12 are preferably spaced apart horizontally by a distance H between about six and about eighteen inches. More preferably, the horizontal distance H between first seat 11 and the second seat 12 is between about nine and about fifteen inches. More preferably, the horizontal distance H between the first seat 11 and the second seat 12 is between about ten and about fourteen inches.

It can be seen that the described embodiments provide a unique and novel swing that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A swing comprising a. a first seat, b. a second seat, and c. a connector joining the first seat and the second seat such that the seats share a swinging motion during operation of the swing, wherein the first seat and the second seat differ from one another in that the first seat is configured to accommodate an adult and the second seat is configured to accommodate a child, wherein the first seat and the second seat are arranged such that the adult and child face one another during operation of the swing, and wherein the second seat is higher off the ground than the first seat.

2. The swing of claim 1, wherein the connector comprises a piped framework having at least a first end and a second end, wherein the first seat is attached to the first end of the framework and the second seat is attached to the second end of the framework.

3. The swing of claim 2, wherein the first seat is suspended from the first end of the framework.

4. The swing of claim 3, wherein the first seat is vertically disposed between about 6 inches and about 16 inches below the second seat.

5. The swing of claim 3, wherein the first seat is a belt seat.

6. The swing of claim 5, wherein the second seat is a bucket seat or a chair seat.

7. A swing comprising:

a. a first seat;

b. a second seat;

c. a connector joining the first seat and the second seat such that the seats share a swinging motion during operation of the swing;

wherein the connector has at least a first end and a second end, wherein the first seat is positioned at the first end of the connector and the second seat is positioned at the second end of the connector;

wherein the swing comprises a plurality of suspension points and the swing is configured to be suspended from a support structure by chains affixed to the suspension points; and wherein the connector is configured so that, when the swing is suspended from a support structure, the first seat is higher off the ground than the second seat.

8. The swing of claim 7, wherein the first seat is configured to accommodate a toddler.

9. The swing of claim 8, wherein the first seat is a bucket seat or a chair seat.

10. The swing of claim 8, wherein the second seat is configured to accommodate an adult.

11. The swing of claim 10, wherein the swing comprises at least four suspension points.

12. The swing of claim 11, wherein the suspension points are positioned so that the chains form a pair of triangular shapes when the swing is suspended from the support structure.

13. The swing of claim 10, wherein the connector comprises a piped framework.

14. The swing of claim 7, wherein the connector comprises a piped framework.

15. The swing of claim 7, wherein the swing comprises at least four suspension points.

16. The swing of claim 15, wherein the suspension points are positioned so that the chains form a pair of triangular shapes when the swing is suspended from the support structure.

17. The swing of claim 16, wherein the connector comprises a piped framework and the connector comprises the suspension points.

* * * * *